US005529095A

United States Patent [19]

Felts et al.

[11] Patent Number: 5,529,095

[45] Date of Patent: Jun. 25, 1996

[54] UNIFORM TOBACCO DISTRIBUTION SYSTEM AND METHOD FOR A TOBACCO PRESS

[76] Inventors: James D. Felts, 21 Walsh Trace Dr., Asheville, N.C. 28803; Paul R. Sexton, Oak Knoll Dr., Etowah, N.C. 28729

[21] Appl. No.: 411,548

[22] Filed: Mar. 28, 1995

Related U.S. Application Data

[62] Division of Ser. No. 42,240, Apr. 1, 1993, Pat. No. 5,404, 919.

[51] Int. Cl.[6] ..... B65B 1/24

[52] U.S. Cl. ..... 141/12; 141/1; 141/80; 141/286; 100/35

[58] Field of Search ..... 141/1, 12, 71, 141/73, 80, 286; 100/35, 66, 185, 193, 215, 225, 229 R; 131/108, 111, 112, 283

[56] References Cited

U.S. PATENT DOCUMENTS

| | | | |
|---|---|---|---|
| 3,186,448 | 6/1965 | Clark | 141/12 |
| 3,288,177 | 11/1966 | Clark | 141/73 |
| 3,595,282 | 7/1971 | Fishburne et al. | 141/73 |
| 3,817,298 | 6/1974 | Fishburne | 141/80 |
| 4,572,065 | 2/1986 | Fishburne | 100/35 |

*Primary Examiner*—J. Casimer Jacyna
*Attorney, Agent, or Firm*—Cort Flint

[57] ABSTRACT

A distribution system for a tobacco press is disclosed which includes a distribution conveyor system 50 and distributor blade assembly that includes a first blade mechanism B and a second blade mechanism C. The blade mechanisms are disposed in upper and lower hopper portions 80*a*, 80*b*, and distribute tobacco into a charger 30*a*. The charger includes a vertical chute 32*a* and an internal container 34*a* which inserts into a tobacco container 22*a* which tobacco is distributed and compressed by means of a press head 12*a*. First blade mechanism B includes a primary distributor blade 82 which can be moved in both a linear motion and a pivotal motion to primarily control the deflection and distribution of tobacco. Second blade mechanism C may include secondary distributor blades 94 and 96 which, when utilized in combination with primary distributor blade 82, provide for quadrant (a, b, c, d) distribution of tobacco into container 22*a*. Clockwise quadrant filling of the container is achieved by having second blade mechanism C first distribute to quadrants "a" and "b", while first blade mechanism B distributes to quadrants "a" and "d" to overlap and define a feed opening only over quadrant "a". First and second blade mechanisms may then be controlled so that a distribution opening is formed over quadrants "b", "c", and "d" sequentially to complete a fill cycle.

6 Claims, 10 Drawing Sheets

UNIFORM TOBACCO DISTRIBUTION SYSTEM AND METHOD FOR A TOBACCO PRESS

This is a divisional of application Ser. No. 08/042,240, filed on Apr. 1, 1993, now U.S. Pat. No. 5,404,919.

BACKGROUND OF THE INVENTION

The invention relates to a tobacco press, and more particularly, to a more uniform distribution of tobacco into a charger of the press and container for subsequent compaction by a press head.

Tobacco presses pack tobacco into cardboard containers and the like in the form of a compressed tobacco cake. The tobacco cake is aged in this form for a period of time. Usually, the tobacco cake is sliced into pieces for further processing after the aging process. Uneven filling of the tobacco in the container often results in mechanical damage during compression such as bending of the press head cylinder rod, nonuniform aging due to density variations in the compressed cake, and/or breakage and degradation of the tobacco particles, usually strips. Furthermore, if the containers are uneven due to uneven distribution and compression, the containers will not stack well.

Previously, tobacco presses have been provided which utilize twin presses. While tobacco is being compressed in a first press, the second press is being filled. The cycle is then reversed, and the tobacco in the second press is compressed while the first press is filled. For example, see U.S. Pat. No. 3,186,448. This patent discloses twin conveyors, one for each press. Each press has a conical distributor which is pivotally supported beneath the press plunger. The distributor is extended into the path of flow when the plunger is retracted and is retracted out of the path of movement of the plunger when the press is filled and the pressing plunger is extended. However, this construction requires that there be an opening in the side of the charger so that the distributor may be retracted when the plunger is extended. This allows dust and moisture and temperature variations in the tobacco being compressed that adversely affects its quality. Moreover, the deflection patterns provided by the distributor are limited, and the distributor may not be capable of distributing the tobacco as desired in all applications.

Other attempts at evenly distributing tobacco in twin tobacco presses have included the use of a single feed conveyor for feeding the charges of the presses which reciprocates horizontally. As the conveyor reciprocates horizontally, it distributes the tobacco back and forth across the inlet to a feed hopper above the charges as the position of the end of the conveyor. In this manner, it is attempted to achieve a desired distribution profile across the open area of the charger, and hence, a desired distribution of tobacco in the tobacco container at the bottom of the charger. While such a construction is somewhat successful in even distribution, the movable conveyor presents a safety hazard. In addition, because the conveyor is movable, it has been necessary to provide an open gap on the sides of the conveyor housing through which dust may escape. The housing is thus open to the atmosphere which allows the moisture content of the tobacco to vary. A proper moisture content of the tobacco is important to prevent breakage and degradation of the strips during distribution in the press, and compression in the container due to brittleness. The overly dried particles break up even more during deflection and compression. When the tobacco cake is sliced at the end of the curing process, the tobacco cake will not slice correctly if it is too compressed. Therefore, uniform distribution and correct moisture content are highly important to proper formation of the tobacco cake and aging of the tobacco. The breakage and damage of tobacco strips is particularly likely in the prior tobacco presses which utilize fixed conveyors where, in an attempt to distribute the tobacco evenly in the charger, it is necessary to propel the tobacco at increased speeds toward the far side of the feed hopper. While the movable conveyor avoids part of this problem, it is susceptible to the above noted safety, moisture, and dust problems.

Accordingly, an object of the present invention is to provide a system for feeding and uniformly distributing tobacco in a tobacco press in a manner that the tobacco strips are not damaged and are evenly compressed.

Another object of the invention is to provide a distribution system for a twin tobacco press having a distribution blade assembly which uniformly distributes tobacco to fill a container in a quadrant pattern.

Another object of the invention is to provide a distribution system for a tobacco press which uniformly distributes the tobacco in the tobacco container and compressed cake while using a stationary conveyor so that the conveyor housing may be enclosed to reduce the escape of dust and variations in moisture and other important parameters of the tobacco.

Another object of the invention is to provide a distribution system for evenly distributing tobacco in a tobacco press having an improved tobacco distributor blade assembly which provides a highly versatile movement that allows a wide variety of deflection patterns for the tobacco without damage.

Another object of the invention is to provide a distribution system for evenly distributing and compressing tobacco in a tobacco press utilizing a stationary conveyor which may be driven at variable speeds, but which are relatively slower to provide a more delicate distribution of the tobacco due to the use of a more compatible distributor blade assembly which has a wide variety of positions.

Another object of the invention is to provide a distribution system for twin tobacco presses utilizing a reversing conveyor which has its outermost conveyor roller extended well into a feed hopper of the charger so that slower speeds may be utilized to distribute the tobacco across the charger yet which allows vertical travel of the press head thereby.

SUMMARY OF THE INVENTION

The above objectives are accomplished according to the present invention by providing a tobacco distribution system for a tobacco press which compresses particles of tobacco into tobacco cakes, where improvements are made to a conveyor system and distributor blade assembly. The tobacco press is often a type which includes at least one tobacco press, and a tobacco distribution system having a distribution conveyor for distributing the tobacco to the tobacco press and a feed hopper for receiving tobacco from the distribution conveyor. A charger is disposed below the hopper having a vertical chute through the tobacco and is distributed into a container disposed below the charger. A vertically reciprocating press head compresses the tobacco in the container. The distribution system, according to the invention, comprises a first distributor blade mechanism having a primary distributor blade for deflecting and distributing the tobacco from the distribution conveyor. There is a first drive mechanism for moving the primary distributor blade to a desired position in the hopper. The drive mechanism includes a carriage having a pivot about which the distributor blade is pivotally carried, a first drive for moving the carriage in linear movement, and a second drive for pivoting the distributor blade about the pivot. A second blade mechanism is disposed below the first blade mechanism in the hopper. The second blade mechanism includes a first secondary distributor blade and a second secondary distributor blade for distributing the tobacco deflected and distributed by the primary distributor blade. A second drive mechanism is provided for moving the first and second secondary distributor blades to a desired distributing position.

The tobacco container is rectangular and includes a cross-section defined by quadrants. In accordance with a preferred embodiment of the invention, the first blade mechanism includes a first position for deflecting and distributing the tobacco into a first and fourth quadrant of the container, and a second position for deflecting and distributing tobacco into a second and third quadrant of the container. The second blade mechanism has a first position for deflecting and distributing the tobacco into the first and second quadrants, and a second position for deflecting and distributing the tobacco into the third and fourth quadrants. In this manner, the container is filled by sequentially distributing the tobacco into the quadrants. The second drive mechanism includes a first actuator for moving the first and second secondary blades relative to each other to establish a desired conical relationship tapering downwardly in the hopper. A second actuator is provided for moving the first and second secondary blades together in the relationship to different distributing positions in the hopper.

The distribution system further comprises a distribution conveyor which includes a plurality of conveyor rollers. In a twin tobacco press, the distribution conveyor has a first end and a second end. The first end of the conveyor extends into the hopper of the first tobacco press, and the second end of the conveyor extends into the hopper of a second tobacco press, the first and second ends of the distribution conveyor terminating in the hoppers in a vertical plane closely adjacent a vertical plane in which the press head travels in reciprocating vertical strokes. A conveyor drive is provided for driving the distribution conveyor in reversing directions and at variable speeds.

A method for distributing particles of tobacco into a tobacco container for compression includes utilizing a tobacco press having a vertical charger through which the tobacco falls from a distributor into the container. The container has a rectangular cross-section having quadrants bounded by four intersecting sides. The method comprises the steps of: (a) distributing an amount of tobacco into a first quadrant of the container near a first and second side of the container to general form a first tobacco stack; (b) distributing an amount of tobacco into a second quadrant of the container near the first tobacco stack, the second side, and a third side of the container to generally form a second tobacco stack; (c) distributing an amount of tobacco into a third quadrant of the container near the second stack of tobacco, the third side, and a fourth side of the container to generally form a third tobacco stack; and (d) distributing an amount of tobacco into a fourth quadrant of the container near the third and first stacks of tobacco, and the third and first sides of the container to generally form a fourth stack of tobacco. Preferably, the steps of (a)–(d) are repeated a prescribed number of times to complete an entire fill cycle.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
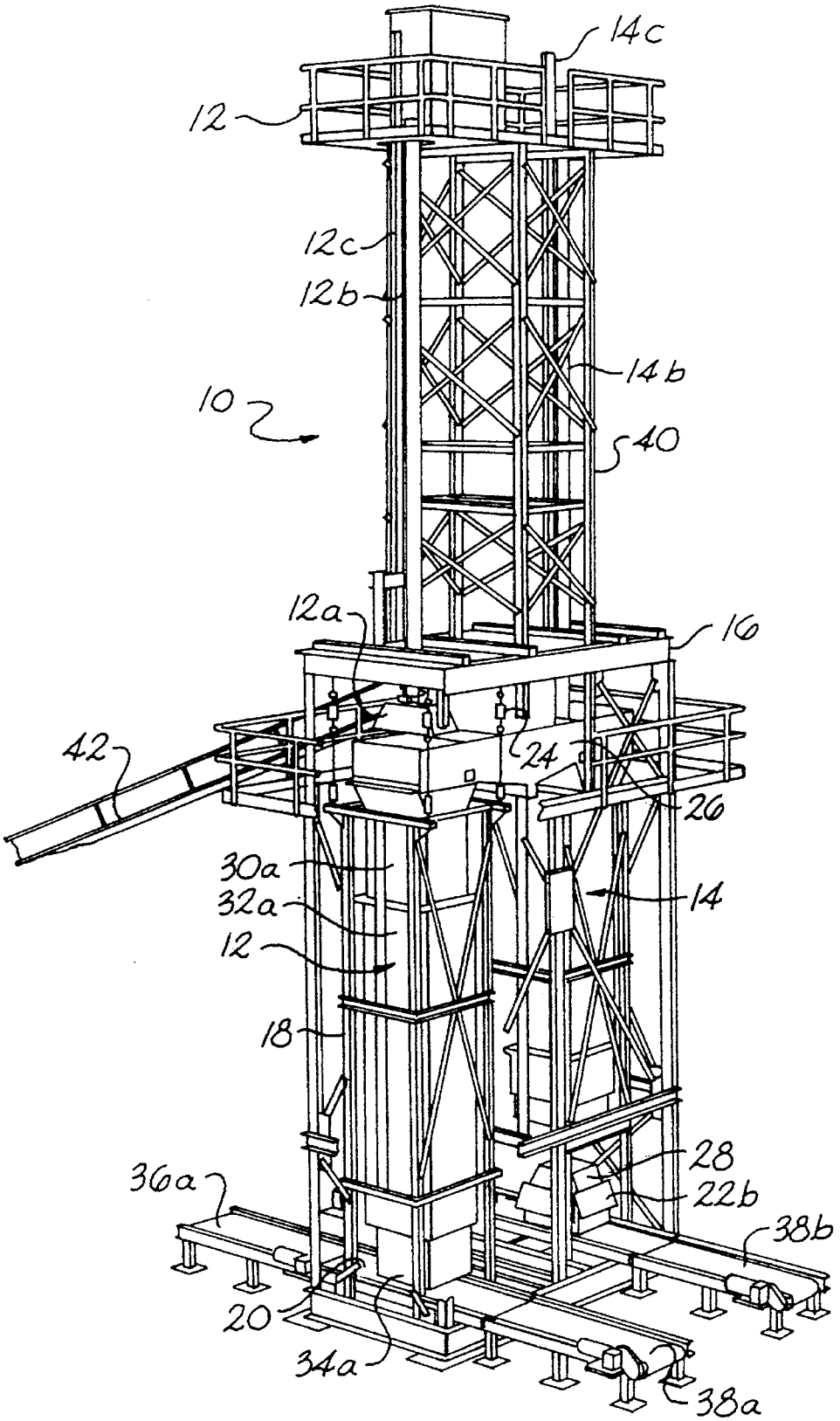
FIG. 1 is a perspective view of a twin tobacco press which maybe provided with a tobacco distribution system according to the invention.

Referring now in more detail to the drawings, a tobacco press, designated generally as 10, is illustrated to which the present invention applies. Since the general components of such tobacco presses are known in the art, only those portions of the tobacco press that are necessary for an understanding of the invention will be disclosed in detail. In the illustrated embodiment of FIG. 1, the tobacco press is illustrated in the form of a twin tobacco press having twin press towers designated generally as 12 and 14. There are press heads 12*a* and 14*a* which enter press towers 12 and 14. When one press head is up during a fill cycle, the other press head is down on a compression cycle. In this manner, one press tower can be filled while the other is in the compression cycle providing a more efficient operation. Also in the typical press, there is a main press frame 16 composed of beams and columns, and a suspended weigh frame 18 also composed of beams, trusses, and columns, which is suspended from the main frame. A belt conveyor and press pad 20 is carried below each press tower by weigh frame 18. A container such as illustrated at 22*b* is on the conveyor beneath the press tower and rests on the pressure pad 20. The empty weight of the container can best be measured by a set of load cells 24 which is connected in the suspension of weigh frame 18. In this manner, tobacco which is fed by a distributor 26 falls through the press tower into the container and is weighed. After a desired weight of tobacco is in the container, it is then compressed into a tobacco cake inside container 22*b*. Typically, the press towers include a stationary charger 30 and a telescoping charger 32 which moves relative to the stationary charger. An internal case sleeve 34 is attached to each end of telescoping charger 32 which is received internally in the case for distribution of tobacco. Entry conveyors 36*a*, 36*b* and exit conveyors 38*a* and 38*b* are provided for the containers to transport the containers for each press tower 12 and 14. Completing the assembly, there is a cylinder support tower 40 carried atop main press frame 16 which supports a pair of main ram cylinders 12*b* and 14*b* which carry the press heads. Stroke control tubes 12*c* and 14*c* assist in controlling the stroke of the press heads. A supply conveyor 42 delivers particles of tobacco, typically tobacco strips, to the distributor 26.

Figure 2:
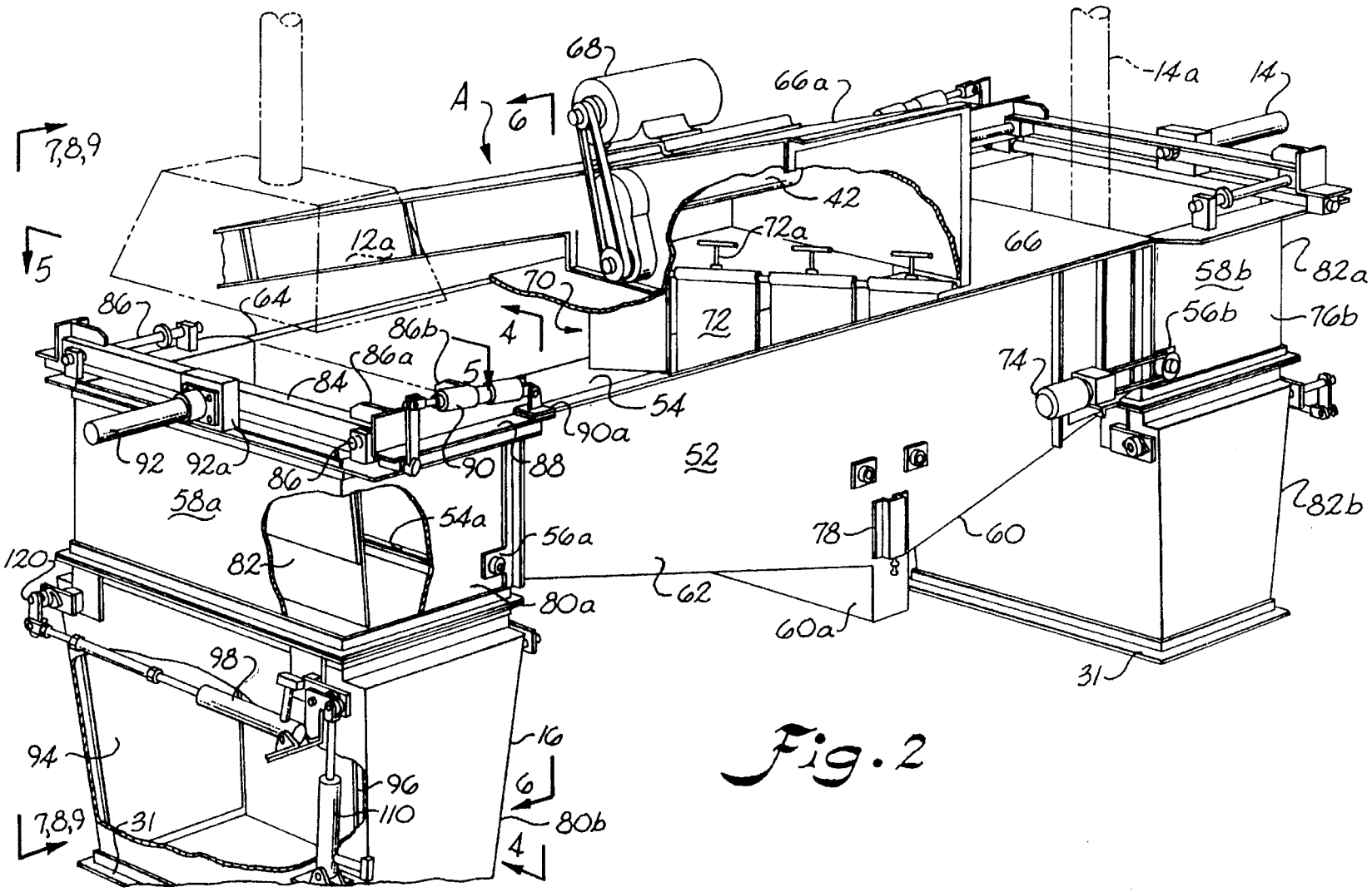
FIG. 2 is a perspective view of the tobacco distribution system which includes a distributor blade assembly for uniformly distributing the tobacco in accordance with the invention.
Figure 3:
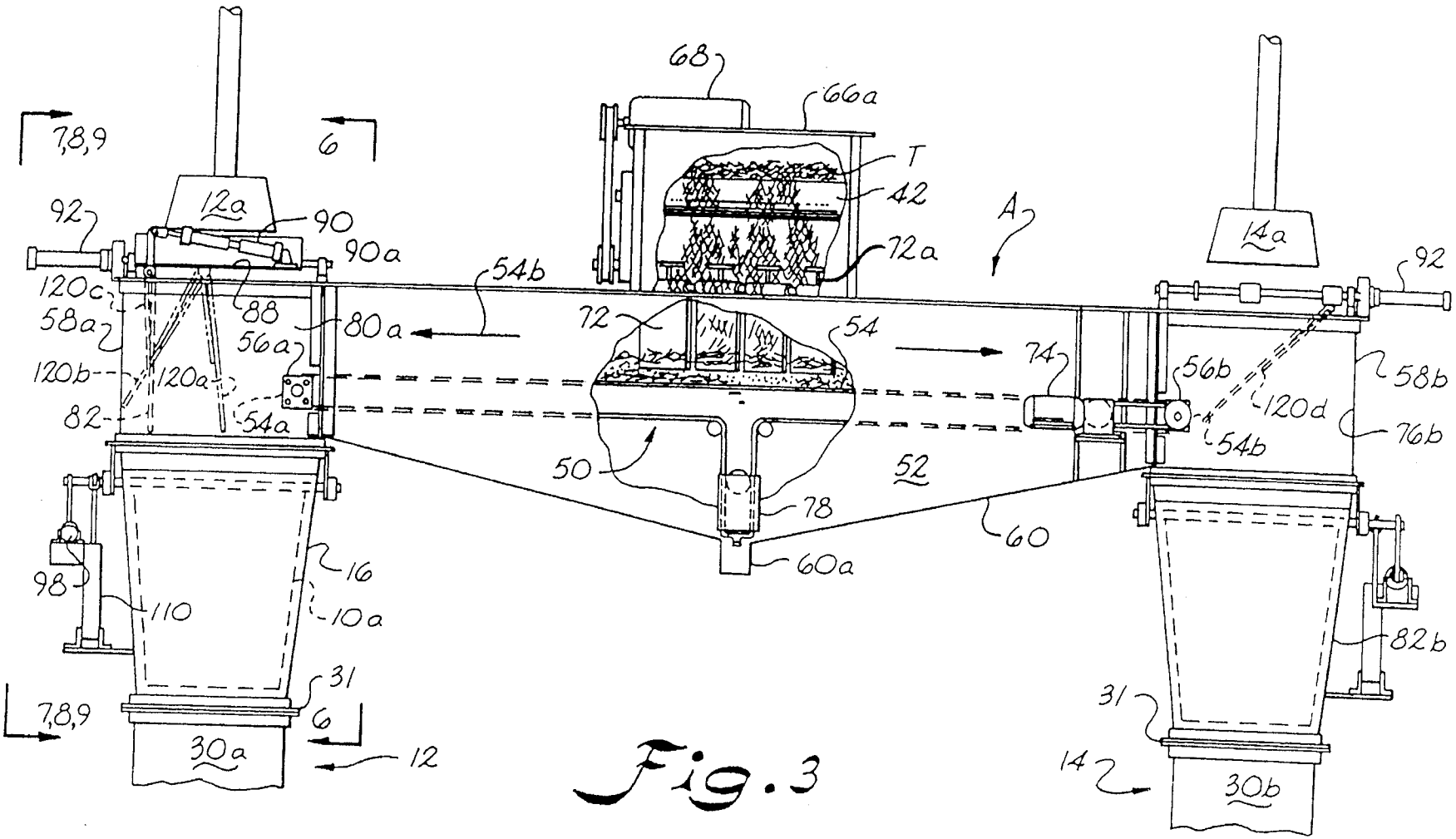
FIG. 3 is a front elevation with parts cut away illustrating the distribution system and distributor blade assembly according to the invention.
Figure 5:
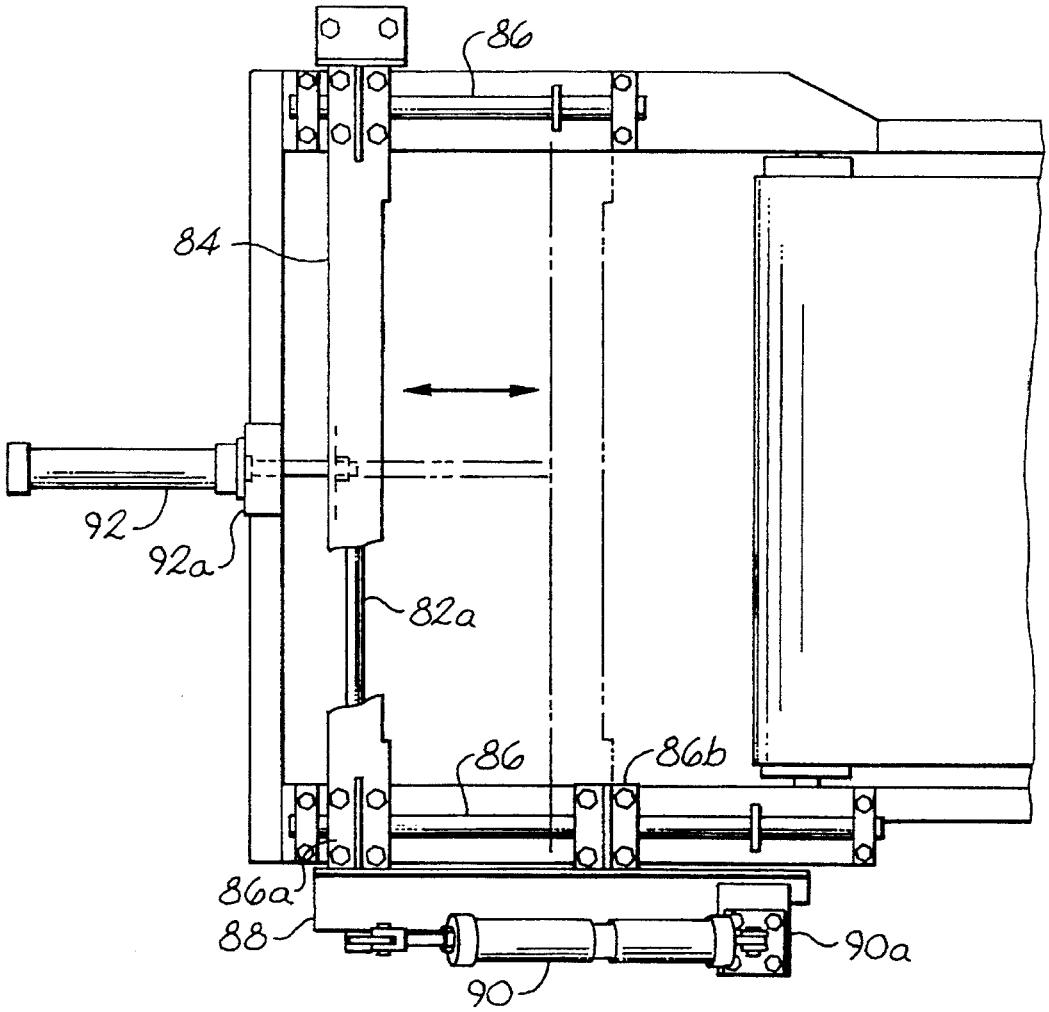
FIG. 5 is a top plan view of the tobacco press and feed hopper of FIG. 3 showing the movement of a primary tobacco distributor blade mechanism in a horizontal plane as well as pivotal movement.

Referring now in more detail to the invention, as can best be seen in FIG. 2, a distribution system, designated generally as A, is illustrated in a form suitable for a twin tobacco press. However, it is to be understood that the principals of the present invention can also be applied to a single press tower. In the illustrated embodiment, distribution system A includes a distribution conveyor, designated generally as 50, which is disposed within a conveyor housing 52. Feed conveyor 42 delivers tobacco T to a belt conveyor 54 which is made endless about a plurality of rollers, as can best be seen in FIG. 3. At least one of the conveyor rollers 56*b* is driven. Roller 56*b* and an opposite end roller 56*a* are disposed within hoppers 58*a* and 58*b*. Each hopper comprises a rectangular cross section, as can best be seen in FIGS. 2 and 5. Conveyor housing 52 comprises a bottom wall 60 and space side walls 62 and 64. A top cover 66 lies on the top of the conveyor housing, bridging the sides, and co-extending with the conveyor belt 54. The top cover includes a chute cover 66*a* which houses feed conveyor 42 which is driven by a motor 68 carried atop the chute by way of appropriate belts and pulleys (FIG. 3). In this manner, distribution of tobacco T by way of feed conveyor 42 into the distribution system and onto distribution conveyor 54 is done in a manner that the escapement of dust into the room is minimized and reduced. In addition, because of the almost total enclosure, variations in the moisture content of tobacco T is reduced providing a more uniform compression and curing of the tobacco. A tobacco "finger" assembly 70 is disposed within the conveyor housing for spreading out the tobacco across the distribution conveyor 54 as it is fed by feed conveyor 42. Tobacco "finger" 70 comprises individual blades 72 whose inclination may be adjusted by means of a T screw 72*a* to provide for different distribution patterns. Side walls 62, 64 of the conveyor housing are made integral with hoppers 58*a*, 58*b* by way of bolts and flanges. An opening is provided for the passage of press heads 12*a*, 14*a* through the top of the hopper, otherwise, the distribution system is essentially closed, avoiding the problems of air gaps between the hopper and side walls of the conveyor housing. Significant dust has been thrown out of the distribution system in prior devices owing to the gaps and air spaces in the sides due to the speed of the driven conveyor propelling the dust particles, as well as possibly tobacco, outward. A conveyor drive 74 is provided for driving roller 56*b* which in turn drives the conveyor belt 54 which is supported and guided by rollers and frames as is necessary.

As can best be seen in FIG. 3, is noted that the ends of the distribution conveyor belt 54, namely at 54*a* and 54*b* actually extend into the hoppers 58*a*, 58*b*, respectively. This is an advantage in that distribution conveyor 54 may be driven at lower speeds and still deliver tobacco to the opposite walls of hoppers 58*a*, 58*b*, i.e. walls 76*a* and 76*b*. It is noted that bottom wall 60 of conveyor half of 52 tapers downwardly and terminates in a collection chamber 60*a* which may be provided with a removable hatch (not shown) for removal dust, trash, and miscellaneous tobacco particles which fall off the conveyor and are collected. A tensioning assembly 78 is provided which consists of rollers and adjustable means that provide for maintaining proper tension on distribution conveyor 54. Drive motor 74 is a variable speed reversible motor that allows for reversing the direction of conveyor belt 54 and hence feeding the tobacco into either hopper 58*a* or 58*b* in alternating cycles. The speed of the conveyor may be adjusted depending on other aspects of the distribution system, as will be described below, to distribute the tobacco in a desired manner. Hopper 58*a* comprises an upper hopper 80*a* and a lower hopper 80*b*. Likewise, the right hopper 58*b* comprises an upper hopper 82*a* and a lower hopper 82*b*. Disposed below hopper 82*b* are stationary chargers 30*a*, 30*b*, which can best be seen in FIGS. 1 and 3. A canvas seal or other replaceable seal means is provided at 31. Various housing, chutes, hoppers, described above, may be formed and structurally fashioned in any conventional manner by using welding, bolts, etc.

Figure 4:
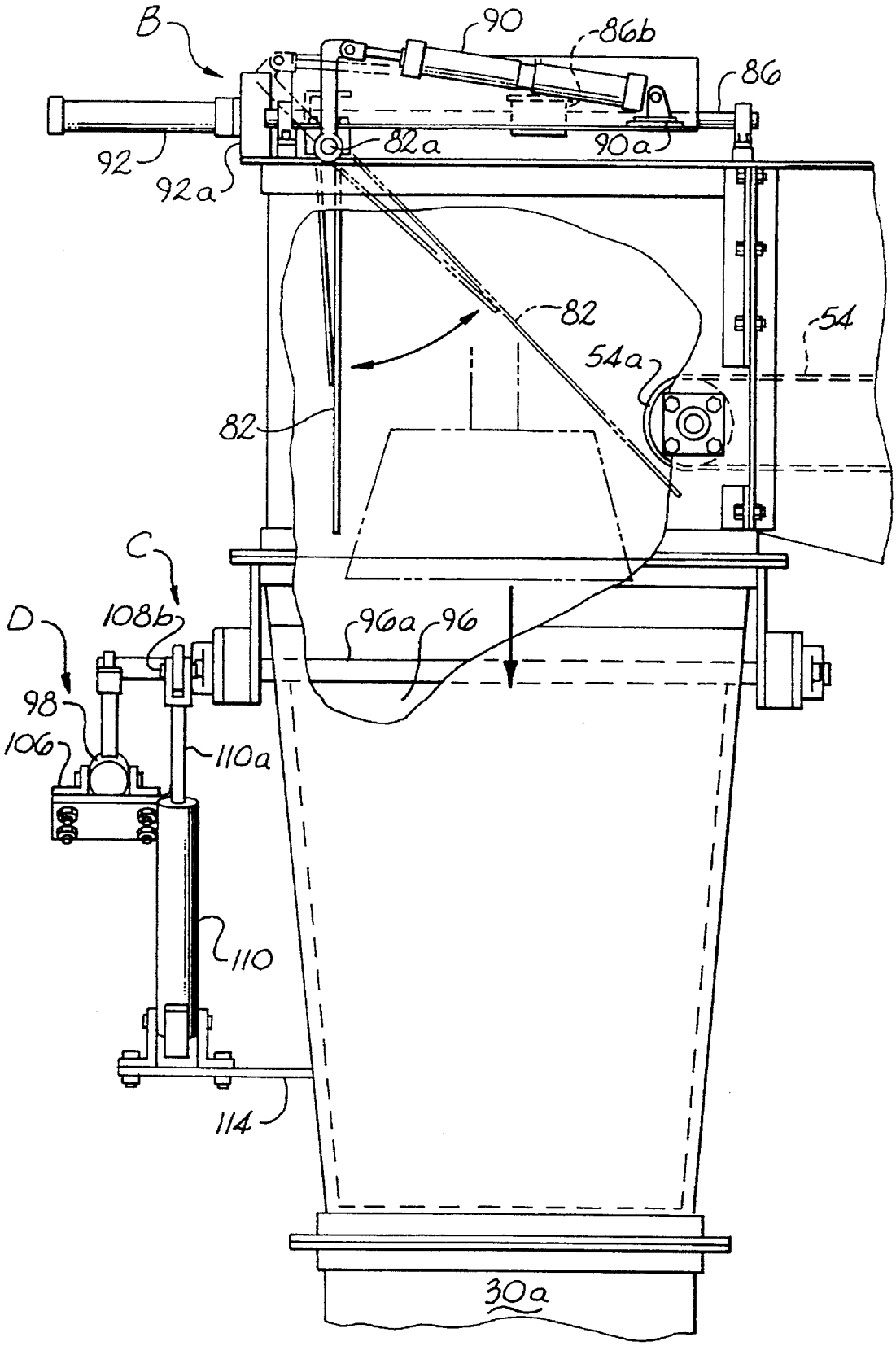
FIG. 4 is a left end view of a tobacco press feed hopper along line 4—4 of FIG. 2 with parts cut away illustrating a distribution system for evenly distributing the tobacco in the charger incorporating a distributor blade assembly having first and second distributor blade mechanisms disposed one above the other so that the tobacco may be evenly distributed in a container for compression.

Referring to FIGS. 4 through 12, aspects of the invention will be described pertaining to an improved tobacco distribution system. Reference will be made to the left tower press 12, it being understood that the description of right tower press 14 is identical or a mirror image of the left side. A distribution blade is disclosed which includes a first blade mechanism, designated generally B, carried in hopper 58*a*, and a second blade mechanism, designated generally C, disposed in hopper 58*a* below first blade mechanism B (FIG. 4). First blade mechanism B includes at least one pivoting distributor blade 82 which is carried by a carriage 84, as can best be seen in FIGS. 4 and 5. Distributor blade 82 is carried by a pivot on carriage 84 which includes a pivot axis 82*a*. The carriage includes a pair of guide rods 86 upon which the carriage and pivotal distributor blade slide. The carriage includes brackets 86*a* which slide or guide rods 86 in a linear motion. Carried by one side of carriage 84 is an angle iron bracket 88 to which is affixed a pivotal drive for distributor blade 82 in the form of a conventional air cylinder 90. Bracket 88 is affixed to bracket 86*a* on one end of the carriage and to a second bracket 86*b* spaced from 86*a*. Both brackets slide on rod 86, and affix the bracket and cylinder 90 to the carriage. In this manner, the distributor blade 82 may be moved to a variety of inclined positions, by the operation of air motor 90, as can best be seen in FIG. 4. Distributor blade 82 deflects and distributes tobacco coming off end 54*a* of distribution conveyor 54 and distribute the tobacco according to a desired pattern. The opposing end of air motor 90 is affixed to angle iron bracket 80 by a plate 90*a*. A linear drive is provided for carriage 84 and hence distributor blade 82 by a conventional air cylinder 92 affixed to carriage 84 by a mounting block 92*a*. Air motors 90 and 92 are controlled in a conventional manner to position carriage 84 and distributor blade 82 as desired.

Figure 6:
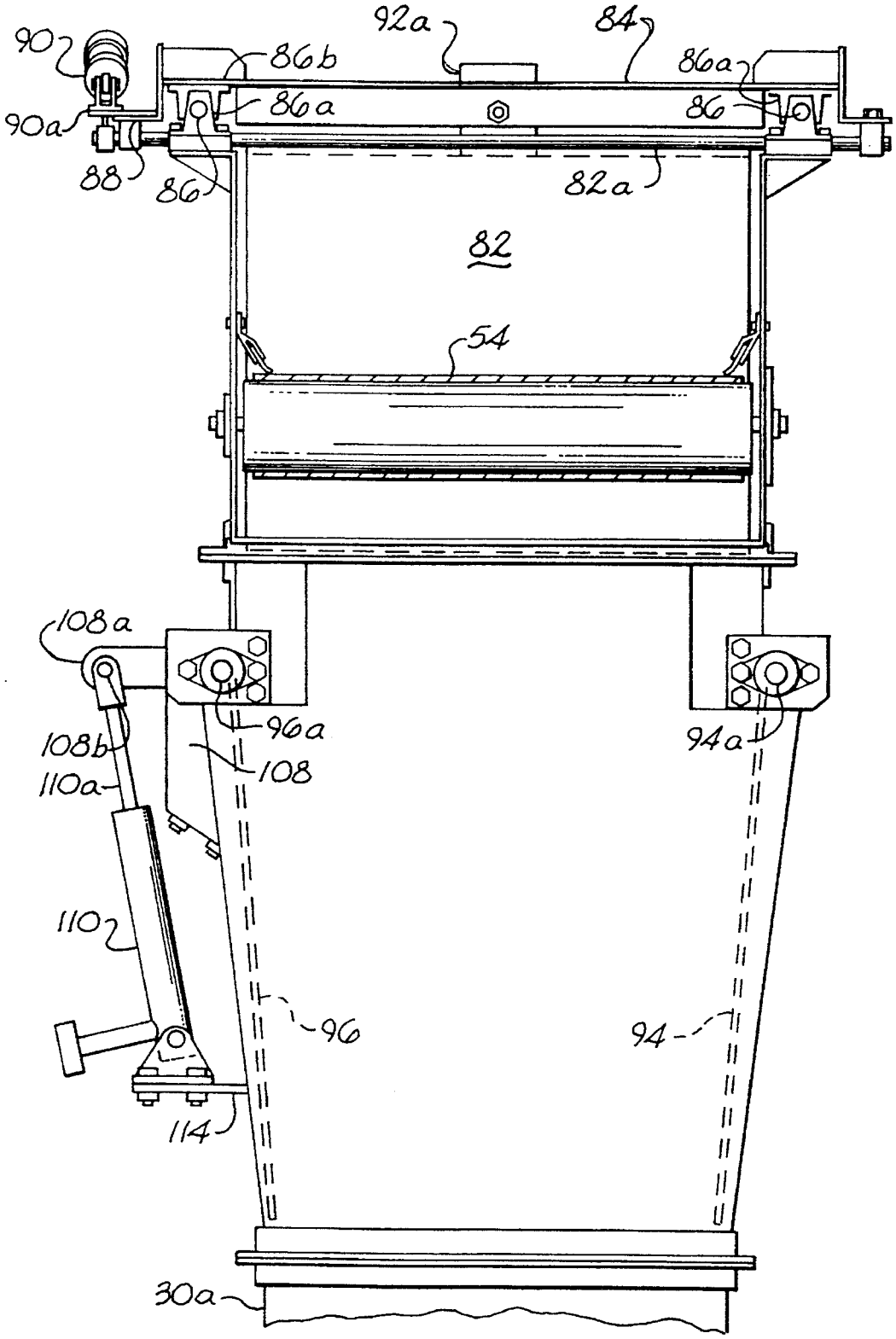
FIG. 6 is a sectional view taken along line 6—6 of FIG. 2.

The distributor blade assembly may further include second blade mechanism C which includes at least one secondary distributor blade 94 and preferably a second secondary distributor blade 96 as can best been seen in FIG. 6. Secondary distributor blades 94 and 96 are disposed below upper distributor blade 82 which functions as a primary distributor blade. It will be noted from the drawings that pivot axis 94*a*, 96*a* of the secondary distributor blades are angularly disposed at a right angle to pivot axis 82*a* of primary distributor blade 82 (FIG. 6).

Figure 7:
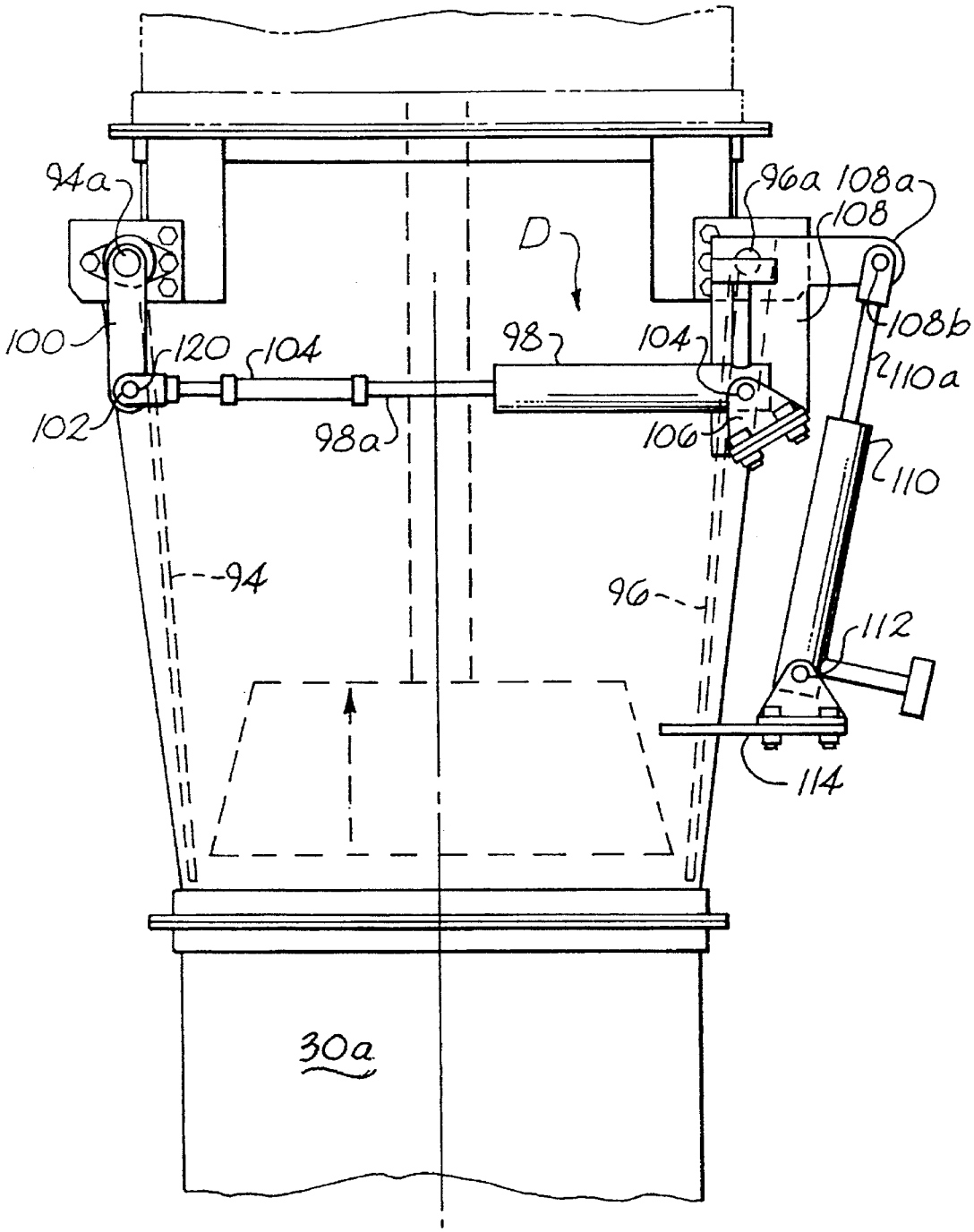
FIGS. 7 is a sectional view taken along line 7—7 of FIGS. 2 and 3 illustrating the secondary distributor blades in a retracted position for reciprocation of the press head.
Figure 8:
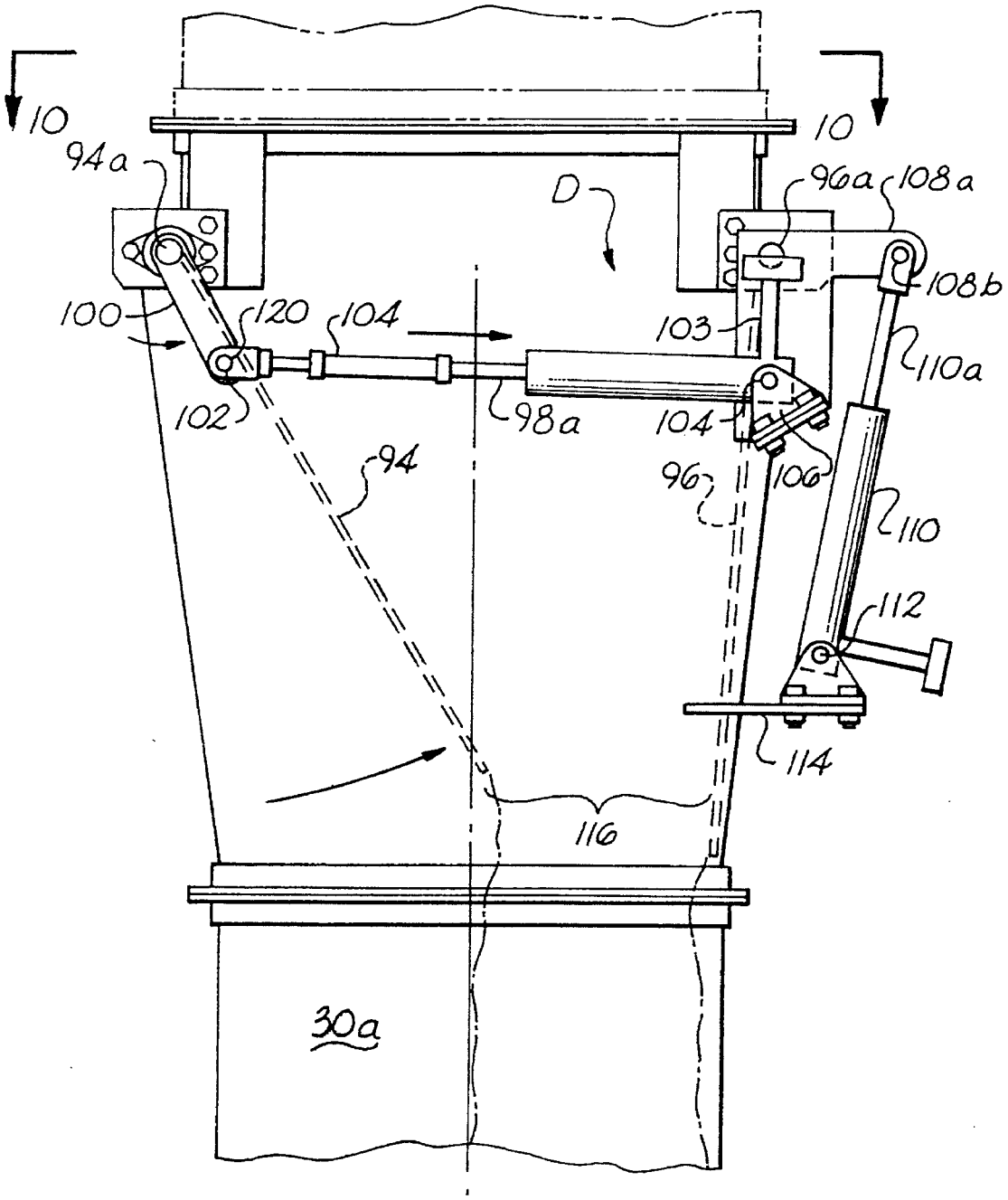
FIG. 8 is a sectional view taken along line 8—8 of FIGS. 2 and 3 illustrating the secondary distributor blades in a first distributing position.
Figure 9:
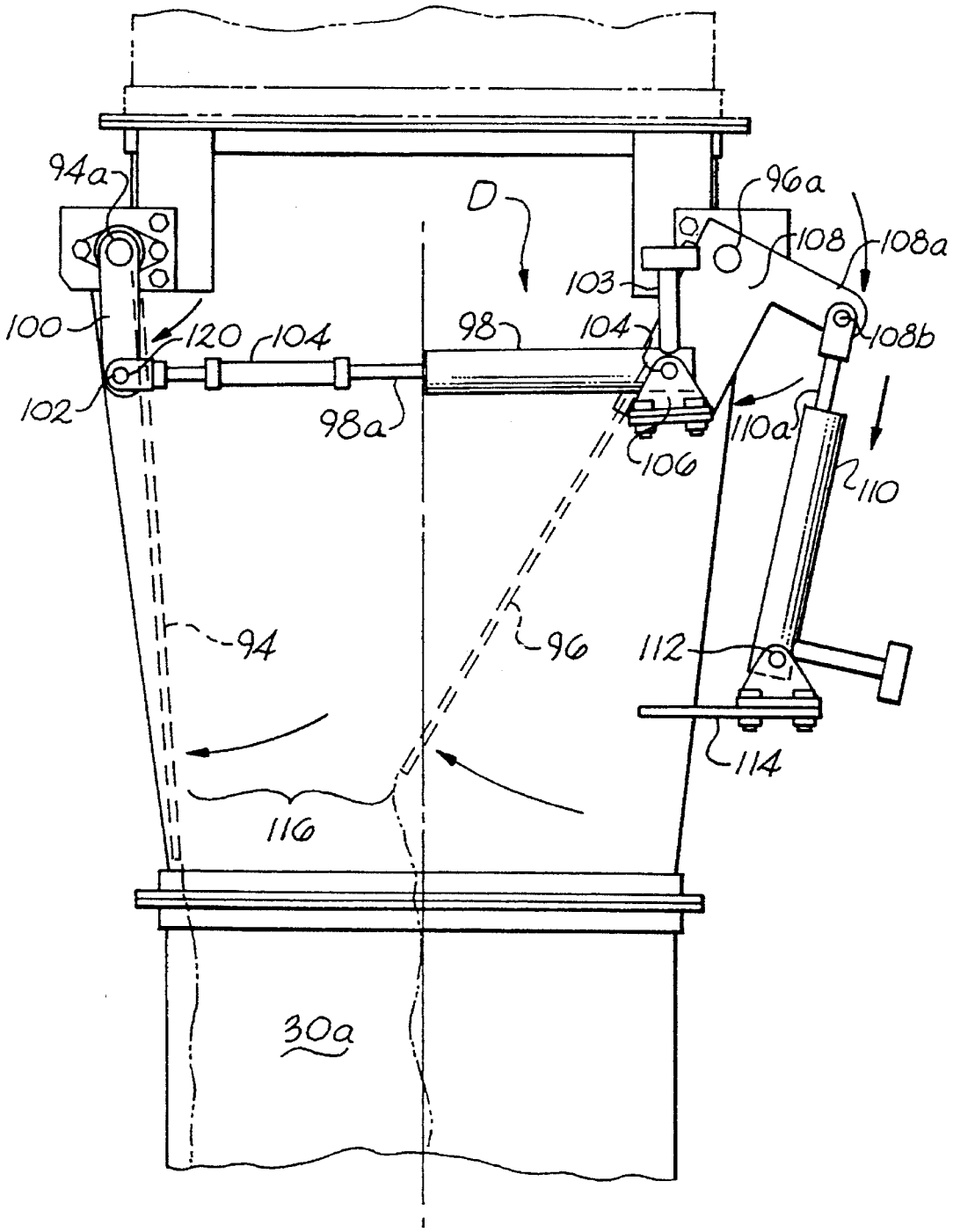
FIG. 9 is a sectional view taken along line 9—9 of FIGS. 2 and 3 illustrating the secondary distributor blades in a second distributing position.

As can best be seen in FIGS. 7 through 9, a drive mechanism, designated as D, is provided for fixing the relationship of the distributor of the secondary distributor blades and in pivoting the blades in that relationship. In the illustrated embodiment, drive mechanisms D includes an first actuator 98 for fixing the relationship between blades 94 and 96. A pivot arm 100 is affixed to pivot 94*a* and has an opposite end attached by a pivot 102 to a linkage 104 which includes a rod 98*a* of actuator 98 which is preferably a conventional air motor. The opposing end of actuator 98 is pivoted at 104 to a web 106 attached to a plate 108 which is pivoted about pivot 96*a*. An arm 108*a* of plate 108 includes a pivot 108*b* to which a rod 110*a* of a second actuator 110 is pivotally attached. The opposing end of actuator 110 is pivoted about a pivot 112 carried by a plate 114 which is attached, such as by welding, to lower hopper 80*b*. It will be noted that a second pivot arm 103 is strung between pivots 96*a* and 104. Pivot arm 103 and pivot arm 100, formed between pivots 94*a* and 102, have the same length or throw. First and second actuators 98 and 110, respectively, are preferably suitable air motors. The operation of first actuator 98 retracts rod 98*a* to a desired fixed position, and does not reciprocate the blades. In this manner, first actuator 98 may be actuated to set the relationship of blades 94 and 96, for example, as can best be seen in FIG. 8 and 9. This relationship is then fixed. The relationship formed is that of a conical cross-section having a feed opening 116, as can best be seen in FIGS. 8 and 9. Once this relationship is fixed, second actuator 110 may then be actuated to move the distributor blades in that relationship to, for example, from the position shown in FIG. 8 to the position shown in FIG. 9, wherein the feed opening 116 is moved from the front half of the feed hopper to the rear half. This movement in cooperation with primary distributor blade 82 enables the container to be filled with tobacco by quadrants, as will be explained more thoroughly. While the distributor blade assembly is illustrated as including primary distributor blade 82 and secondary distributor blades 94, 96, it is to be understood, of course, that in some applications it may suffice that the press include only the primary distributor blade mechanism B. In particular, in many applications it may be necessary only to use first blade mechanism B and the drives therefore. When utilizing secondary distributor blade 94, 96, it may not be necessary to utilize the tobacco distribution rake 72. This is because the secondary distributor blade afford such effective control of the distribution of the tobacco in combination with the primary distribution blade 82.

Figure 13:
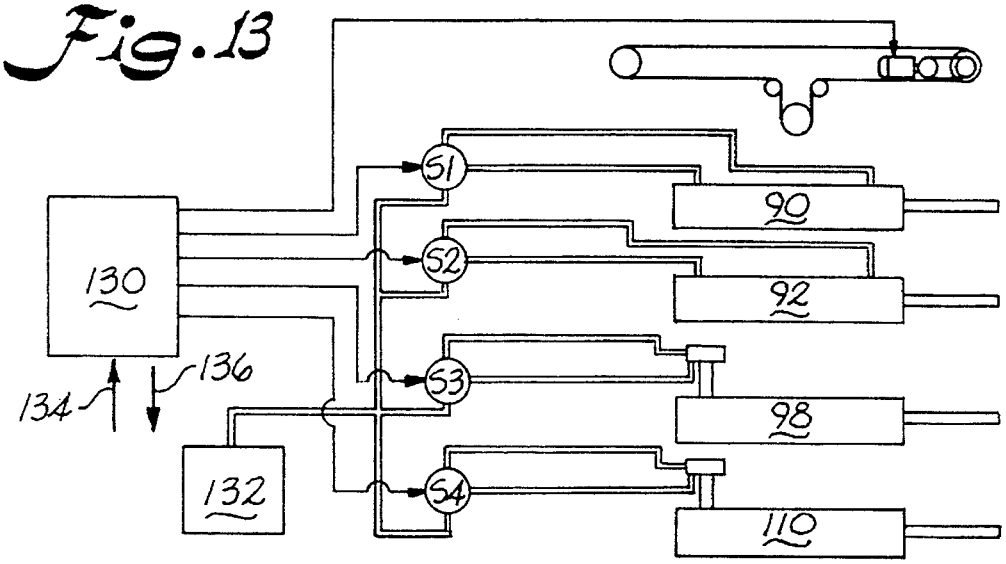
FIG. 13 is a schematic diagram of one embodiment of a control for the distribution system and the blade mechanisms of the present invention.

The blade mechanisms B and C may be controlled in any suitable manner. A suitable control for the distribution system may be provided by one of average skill in the control art having been taught the operation and sequence for the invention. For example, as can best be seen in FIG. 13, a basic control is illustrated which includes controller or computer 130 which may be programmed to control 3-way electrical solenoids, S1, S2, S3, S4, which control air to or from air lines to air cylinders 90, 92, and air motor 98, 110, respectively. A source of air 132 communicates with the air lines. A tobacco weight signal 134 is provided from load cells 24 to indicate a desired amount of tobacco fill and/or a time signal may also be utilized. A stroke signal 136 raises and lowers press head 12*a* after a fill cycle. Preferably, the sequence is timed and provides for filling the container by quadrants, as will be more fully explained below, using repetitive fill sequences during a single fill cycle.

OPERATION

Having described the distributor blade assembly which includes first and second blade mechanisms, and improved distribution conveyor features the operation of the invention will now be described. As explained above previously, distribution conveyor 50 delivers tobacco first to one side of the press and then to the other side in alternating fill and compression cycles. For example, while tobacco press 12 on the left side is being filled, press head 14*a* is compressing tobacco in container 22*b* which has been previously filled.

The operation will now be described in reference to left tobacco press 12, and distribution system described previously. At the beginning of the fill cycle, press head 12*a* is in its raised position as shown FIGS. 2 and 3. Distribution conveyor 54 is traveling to the left as shown by arrow 54*b* in FIG. 3. Distributor blade 82 has been moved to a first, start position where pivot 82*a* is near the center of upper hopper 80*a* as shown by dotted line 120*a*. The primary distributor blade is either vertical or has its free edge inclined slightly towards the distribution conveyor. In this position, the secondary distributor blades are oriented in a first position, and fixed in their relationship as shown in FIG. 8. The distributor blades are now in the position to fill the first quadrant "a" of container 22*a*, as can best be seen in FIGS. 10 through 12. It has been found that filling the container by quadrants, which is provided by a controlled combination of the primary and secondary distributor blades, certain advantages are provided.

Figure 10:
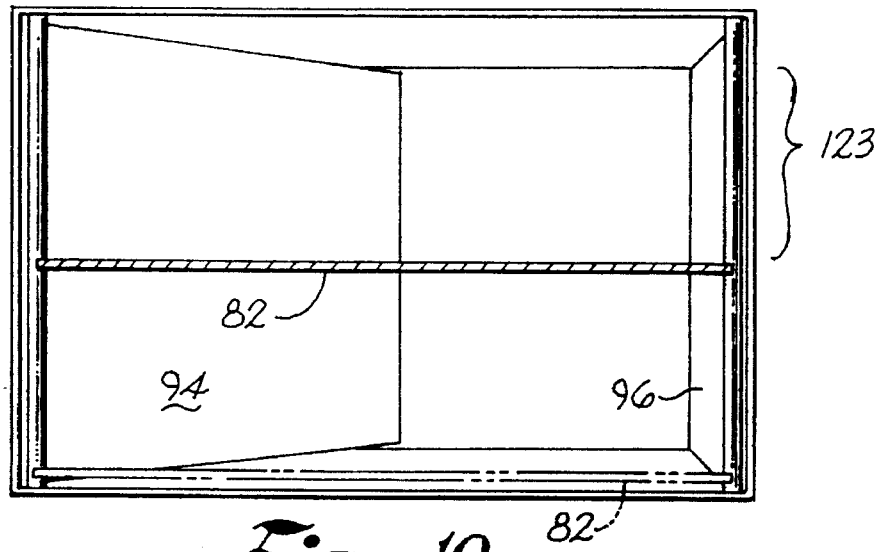
FIG. 10 is a top plan view taken along line 10—10 of FIG. 8 illustrating a container receiving tobacco distributed by the distribution system according to the invention wherein the primary and secondary distribution blades are shown in a initial position for distributing tobacco in a starting quadrant of the container.
Figure 11:
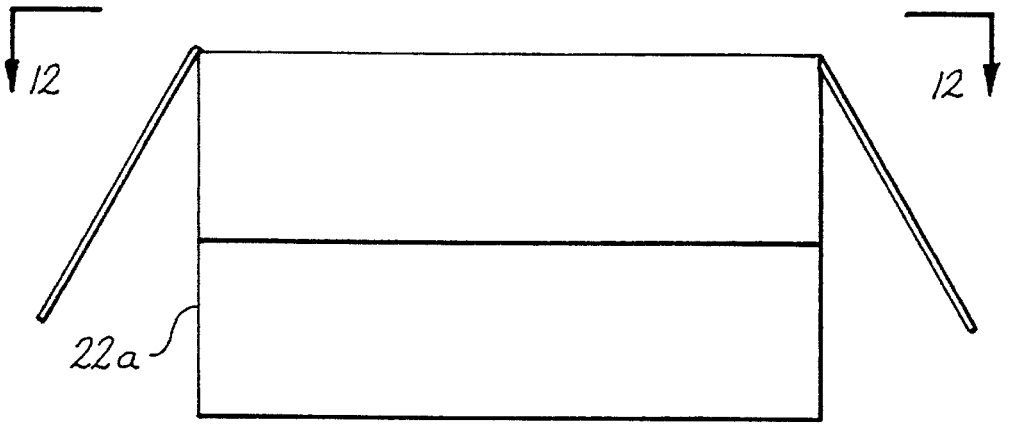
FIG. 11 is an elevation illustrating a tobacco container positioned for filling below a charger according to the invention.
Figure 12:
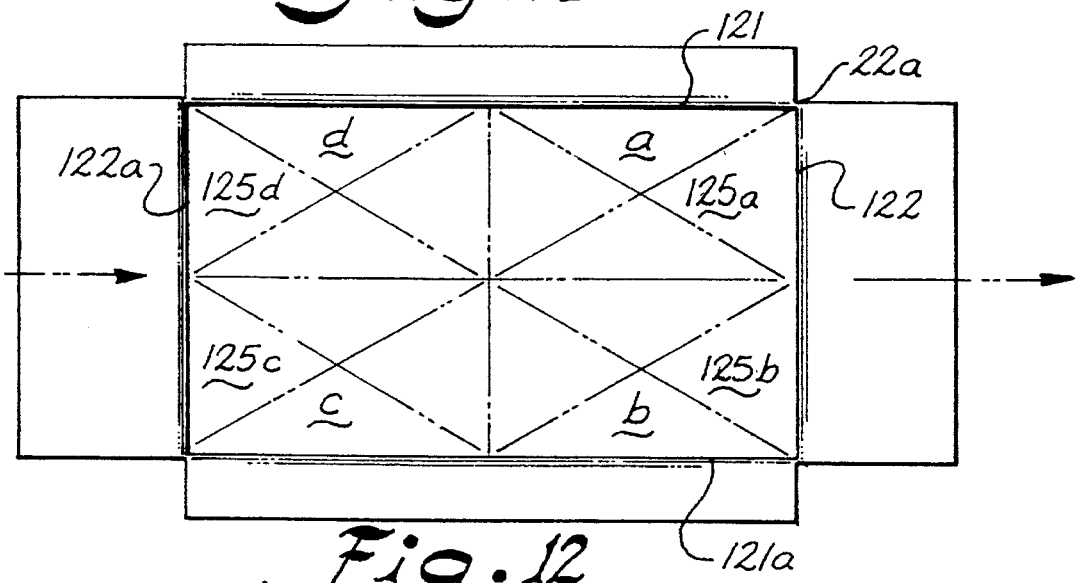
FIG. 12 is a top plan view illustrating a quadrant fill pattern by which distributor blades of a uniform tobacco distribution system fill a tobacco container according to the invention for more uniform compression of the tobacco in the container.

Preferably, filling is done sequentially in quadrants a, b, c, d of container 22*a*, either clockwise or counterclockwise. First, with the primary and secondary distributor blades as shown in FIGS. 3, 8, and 10 tobacco is first distributed into a quadrant "a" of container 22*a*. This corresponds to the upper right hand corner of the container below charger 32*a*. The long sides 121, 121*a* of the container are parallel to the direction of travel. In the illustrated quadrant filling method, the filling proceeds in a clockwise direction from quadrants "a" to quadrants "d" (FIG. 12). Second, after quadrant "a" is filled, primary distributor blade 82 is pivoted rearwardly to the dotted line position 120*b* (FIG. 3). In this position, the tobacco is distributed into quadrant "b" of the container, since secondary distributor blades 94 and 96 retain their fixed conical relationship feeding into the front half of the container as viewed in FIGS. 8 and 10. Third, after quadrant "b" is filled, the secondary distributor blades are moved from the position of FIG. 8 to the position of FIG. 9 which provides for filling of the rear half of container 22*a*, i.e. quadrants "c" and "d", in that order. Since primary distributor blade 82 remains in the dotted line position 120*b* of FIG. 3, tobacco is distributed into quadrant "c". It will be noted that when primary distributor blade 82 is moved to the rear dotted line position 120*b*, the speed of conveyor 54 may be increased so that tobacco is propelled against the deflecting surface presented by the distributor blade and does not fall into a space 123 which corresponds to the upper half of container 22*a*. Fourth, primary blade 82 is pivoted to the forward dotted line position 120*a* (FIG. 3). Secondary blades remain as shown in FIG. 9, and quadrant "d" is filled.

From the above description, it can be seen that first blade mechanism B includes a first position for deflecting and distributing the tobacco into a first and fourth quadrant (a, d) of the container, and a second position for deflecting and distributing tobacco into a second and third quadrant (b, c) of the container. Second blade mechanism C has a first position for deflecting and distributing the tobacco into first and second quadrants (a, b), and a second position for deflecting and distributing the tobacco into third and fourth quadrants (c, d) whereby the container is filled by sequentially distributing the tobacco into the quadrants when the primary and secondary distributor blades are controlled in combination. The sequence of the filling cycle may be varied. For one example, the filling cycle may take place over about 60 seconds and the distributor blades may be cycled three times so that three fillings of the quadrants take place with the cycled time for each quadrant filling being approximately twenty seconds. Hence, an initial filling sequence takes place for 20 seconds. The sequence is then repeated twice again for a total fill cycle of 60 seconds. After the entire fill cycle is completed, primary deflector blade 82 is moved to the retracted dotted line position 120*c* shown in FIG. 3 by actuation of linear drive air motor 92. The secondary distributor blades are moved to their retracted position shown in dotted lines in FIG. 6. With the distributor blades 82, 94, 96 moved to their retracted positions, it is then time for press head 12*a* to begin its compression stroke passing through hopper 58*a* and press charger 12 to compress the tobacco in container 22*a*, and a signal 136 is transmitted. During the compression stroke of press head 12*a*, right press tower 14 is being charged with tobacco as the filling cycle is now taking place in the right hand press.

While the above description and operation have been set forth in relation to the left press 12, it is to be understood that the components of the distribution system and press and their operation is identical to the right press 14.

Thus, it can be seen that an advantageous distribution system and method can be had according to the invention, which provides a more uniform distribution of tobacco in a container and uniform compression. The quadrant filling of container 22 provides the expedient that a first stack of tobacco 125*a* in quadrant "a" is distributed near the corner of sides 121 and 122. The next stack of tobacco 125*b* distributed in quadrant "b" is distributed near the side of stack 125*a* in quadrant "a", side 122, and side 121*a*. The stack of tobacco 125*c* distributed next in the quadrant "c" is distributed near the side of stack 125*b* in quadrant "b", side 121*a*, and side 122*a*. Finally, the distribution of tobacco in quadrant "d" in stack 125*d*, is stacked near four side surfaces, that is, against the tobacco stack 125*a* and 125*c* in quadrants "a" and "c", and sidewalls 122*a* and 121. By using a plurality of filling sequences in each fill cycle, it is possible to distribute the initial stack of tobacco in quadrant "a" without it falling over excessively. For example, a stack of tobacco three or four feet may be stacked fairly uniformly. The next subsequent stacks of tobacco in quadrants "b", "c", and "d" are stacked against supporting surfaces of the previous tobacco stacks and container. In this manner, a highly uniform distribution of tobacco in the container is achieved.

In accordance with the present invention, a method is disclosed for distributing and compressing tobacco in a rectangular tobacco container which comprises filling the rectangular container by quadrants. The method includes filling a first quadrant of the container with the prescribed amount of tobacco near first and second sides of the container. Second, dispensing a prescribed amount of tobacco into a second quadrant of said container near the second side and a third side of said container. Third, dispensing a prescribed amount of tobacco into a third quadrant of the container to form a third tobacco stack dispensed against the third side of the container and a fourth side of the container, and the second stack of tobacco. Fourth, the method includes dispensing a prescribed amount of tobacco into a fourth quadrant of the container to form a fourth stack of tobacco bounded by the third side of the container and a fourth side of the container, as well as the first and third stacks of tobacco. Preferably, the above distribution method is accomplished in multiple sequences wherein each sequence contains the above four steps, and is repeated a number of times to complete an entire fill cycle. While the method has been described in terms of distributing the tobacco against sides of container 22*a*, it is to be understood that this is for reference only, and that normally charger internal sleeve 34*a* will be inserted in the container so that actually, the tobacco will distribute and stack against the corresponding sides of the sleeve rather than the container. The function and description of the sleeve and container are equivalent since their cross-sections are generally the same.

While a preferred embodiment of the invention has been described using specific terms, such description is for illustrative purposes only, and it is to be understood that changes and variations may be made without departing from the spirit or scope of the following claims.

What is claimed is:

1. A method for distributing particles of tobacco into a tobacco container for compression which includes utilizing a tobacco press having a vertical charger through which the tobacco falls from a distributor into the container, said container having a rectangular cross-section having quadrants bounded by four intersecting sides, wherein the method comprises:

(a) distributing an amount of tobacco into a first quadrant of said container near a first and second side of said container to generally form a first tobacco stack;

(b) distributing an amount of tobacco into a second quadrant of said container near said first tobacco stack, said second side, and a third side of said container to generally form a second tobacco stack;

(c) distributing an amount of tobacco into a third quadrant of said container near said second stack of tobacco, said third side, and a fourth side of said container to generally form a third tobacco stack; and (d) distributing an amount of tobacco into a fourth quadrant of Said container near said third and first stacks of tobacco, and said fourth and first sides of said container to generally form a fourth stack of tobacco.

2. The method of claim 1 including the steps of (a)–(d) a prescribed number of times to complete an entire fill cycle.

3. The method of claim 1 comprising compressing said stacks of tobacco in said container.

4. A method of forming compressed tobacco cakes in a tobacco press wherein loose tobacco particles are distributed into a rectangular container having a rectangular cross-section defined by four sides intersecting at four corners of said container to define corner quadrants, each of said quadrants including one of said corners wherein the method comprises distributing amounts of tobacco successively into each of said quadrants of said container according to a prescribed order, and compressing said tobacco.

5. The method of claim 4 wherein said prescribed order of filling of said quadrants is either clockwise or counterclockwise.

6. The method of claim 4 wherein said sequence of filling said quadrants is repeated a number of times to complete an entire fill cycle.

* * * * *